United States Patent [19]

Roberts

[11] Patent Number: 4,556,254

[45] Date of Patent: Dec. 3, 1985

[54] BACKREST

[75] Inventor: Frank L. Roberts, Thornhill, Canada

[73] Assignee: Bio-Support Industries Limited, Toronto, Canada

[21] Appl. No.: 667,579

[22] Filed: Nov. 2, 1984

Related U.S. Application Data

[63] Continuation of Ser. No. 330,877, Dec. 15, 1981, abandoned.

[51] Int. Cl.[4] ..... A47C 7/02

[52] U.S. Cl. ..... 297/460; 297/452; 297/DIG. 1; 297/DIG. 2

[58] Field of Search ..... 297/460, 458, 459, DIG. 1, 297/DIG. 2, 284, 452, 453, 219, 285

[56] References Cited

U.S. PATENT DOCUMENTS

| | | | |
|---|---|---|---|
| 2,514,685 | 7/1950 | Virtue | 297/460 |
| 2,775,999 | 1/1957 | Goodeve | 297/284 |
| 2,808,875 | 10/1957 | Bargen | 297/DIG. 2 |
| 3,034,830 | 5/1962 | Avedon | 297/DIG. 2 |
| 3,133,765 | 5/1964 | Kramer | 297/DIG. 2 |
| 3,146,028 | 8/1964 | Grosfillex | 297/DIG. 2 |
| 3,201,172 | 8/1965 | Bliss | 297/DIG. 2 |
| 3,446,531 | 5/1969 | Froelich | 297/284 |
| 3,720,441 | 3/1973 | Corchran | 297/284 |
| 4,218,090 | 8/1980 | Hoffacker et al. | 297/195 |

*Primary Examiner*—William E. Lyddane
*Assistant Examiner*—Mark W. Binder
*Attorney, Agent, or Firm*—Kenneth M. Garrett

[57] ABSTRACT

A backrest comprising a moulded shell support having in medial longitudinal section a shallow S shape and in lateral section a shallow concave shape. The support is upholstered by a foam layer and a fabric cover stretched between the lateral margins to assist in delocalizing pressures on the back of a user and assist in ventilating the backrest.

10 Claims, 8 Drawing Figures

BACKREST

This application is a continuation of application Ser. No. 330,877, filed Dec. 15, 1981, now abandoned.

FIELD OF INVENTION

This invention relates to backrests or supports. Whilst it is particularly described in relation to light, portable backrests it is not necessarily restricted thereto.

BACKGROUND OF INVENTION

Backache has been aptly termed a universal affliction, it being estimated that some 80 percent of the worlds' population experiences back problems at some period of their lives. In North America some 3 to 4 percent of the populace is said to be afflicted to an extent to be considered at least partially disabled. Conventional treatments include the use of orthopedic braces to hold the back immobile, to a greater or lesser extent for prolonged periods of time. Such braces vary from plaster of Paris body casts, to hard leather devices which are strapped to the body, but to which the body conforms rather than the support conforming to the body unless custom fitted. Whilst is is considered to be preferable that a back support be structured to the body measurements of individual users, this is not practical in relatively low cost items.

In the case of chronic suffers of back problems correct posture can often offer relief. Unfortunately most chair backs do not provide proper support, particularly in the lumbar region of the spine.

It is then, an object of this invention to provide a backrest which aids in providing good posture and support for the back.

It is a further object of the invention to provide a light, portable backrest of the above type.

It is another object of the invention to provide a backrest which has a resilience in lateral direction to conform to various body shapes, but which is relatively stiff in longitudinal directions so as to support the back.

It is yet another object of the invention to provide a backrest having adequate stiffness but which is ventilated to enhance user comfort.

SUMMARY OF INVENTION

In accordance with one aspect of the invention, a backrest comprises a shell support having in medial longitudinal section a shallow S shape, and in lateral section a shallow concave shape, the shell support being relatively stiff and unyielding in medial longitudinal portions and relatively resilient in transverse medial portions when subject to normally applied back pressure, so as to tend to conform to the girth of a user.

Preferably the shell support comprises a central portion having opposed wing portions projecting therefrom at each side thereof in a unitary structure. Desirably the thickness of the shell support reduces progressively in passing from the central portion to the wing portions, so as to increase the lateral resilience of the shell support, although such resilience must always be commensurate with the wing portions having adequate stiffness to provide support to the back of a user of the backrest.

It is additionally preferred that the medial longitudinal portions of the shell support be proportioned so that the area of inflexion of the S shape locates at about mid height of such portions.

In accordance with another aspect of the invention the shell support is provided with a plurality of openings therein to permit the escape of heat therethrough. Desirably a pair of laterally elongated window openings are provided for this purpose, these window openings further serving to increase the resiliency of the shell support in lateral planes. These laterally elongated window openings intersect the longitudinal medial section of the shell support above and below the area of inflexion respectively; the backrest is normally used wherein the window openings overlay mid sections of the thoracic vertebrae and mid sections of the lumbar vertebrae respectively. As a corollary, non-windowed sections of the shell support locate to support upper and lower portions of the thoracic vertebrae and lumbar vertebrae respectively.

In accordance with yet another aspect of the invention the back support is upholstered on the concave side thereof with a soft, resilient sponge material, this in turn being covered with a cloth cover which is preferably stretchable in a lateral direction, the cloth cover spanning between the laterally opposed margins of the back support under tension so as to be unsupported in medial portions thereof and create an air pocket between the cover and support, which air pocket is collapsible to expel air therefrom and ventilate the backrest.

The above objects and aspects of my invention will be made more clear, and still others and the advantages thereof will become evident from the following disclosure of a preferred embodiment of the invention, taken in conjunction with the accompanying drawings.

DESCRIPTION OF PREFERRED EMBODIMENT

Figure 1:
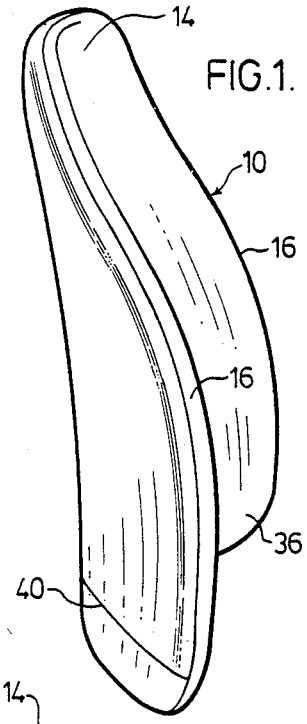
FIG. 1—shows the backrest of the invention in a frontal perspective view.
Figure 2:
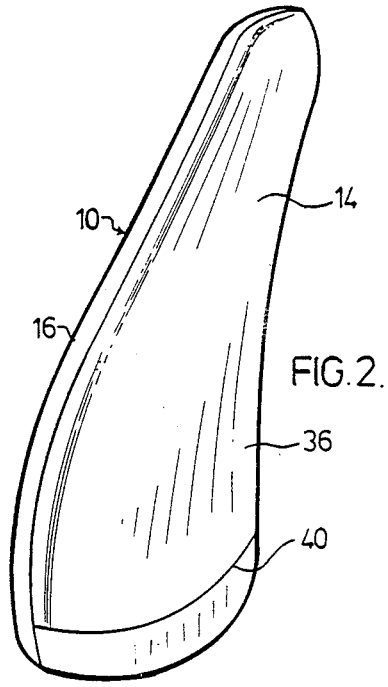
FIG. 2—shows the backrest of FIG. 1 rotated through about 180° about its longitudinal axis.
Figure 3:
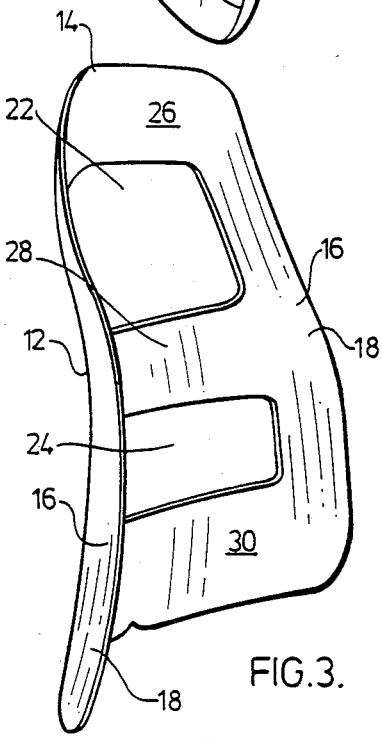
FIG. 3—shows an interior shell frame of the backrest in frontal perspective view.
Figure 6:
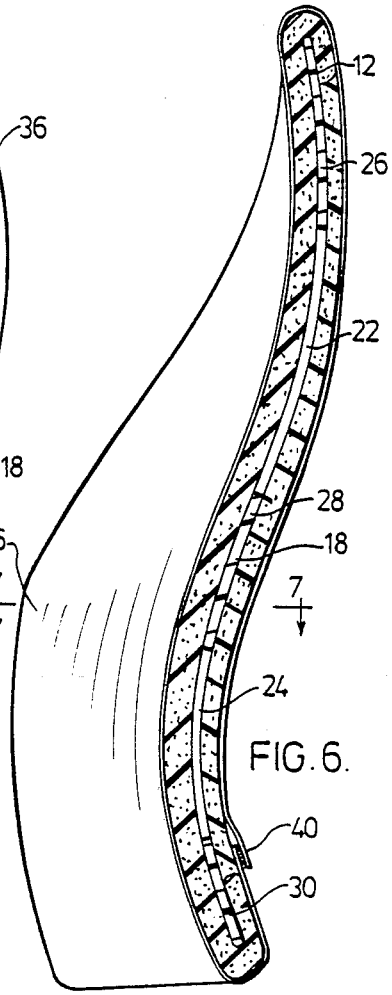
FIG. 6—is a view partly in section along 6—6 of FIG. 5.
Figure 7:
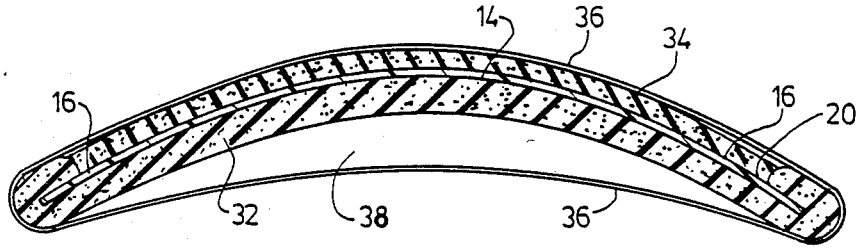
FIG. 7—is a sectional view along 7—7 of FIG. 6.

Referring to the drawings in detail, a backrest is indicated generally therein by the numeral 10. Backrest 10 comprises a shell support 12 having a central portion 14 and opposed wing portions 16 which project from each side thereof, the wing portions increasing generally in their lateral dimension on approach to the lower areas of the backrest. Shell support 12 is generally arcuately formed with a shallow concave section taken laterally, as seen in FIG. 7. In medial longitudinal section shell support 12 is a shallow S shape, best seen in FIG. 6, corresponding generally to the normal curvature of the spine of a person in an erect position taken between the lower lumbar vertebrae and about the fourth upper most thoracic vertebrae, the area of inflexion 18 of the S shape thereby locating at about mid height of central portion 14. The shallow S shape of the shell support extends outwardly to the lateral margins 20 of the shell support, as seen best in FIG. 3.

Shell support 12 has a pair of relatively large laterally elongated window openings 22,24 which extend from adjacent opposed lateral margins 20 respectively thereby forming three relatively broad horizontally spaced back support areas or bands 26,28,30, band 28 being generally coincident with zone of inflexion 18 at least in medial portions of the shell support. Shell support 12 is typically moulded in a plastic material having a relatively high shear modulus, polycarbonate resin and glass fibre reinforced thermosetting polyester resins having been found to be particularly satisfactory because of the relatively high stiffness afforded by moderately thin sections thereof. Typically medial sections of shell support 12 will have a thickness of some 3.5 to 4 mm, this decreasing by some 20 percent on approach to lateral margins 20.

Shell support 12 is upholstered with a layer of spongy foam material 32 adhered to the concave side of the support, a thinner layer 34 of spongy foam material on the backside of the support completing the envelope. Preferably foam material layers 32,34 are open celled to permit the passage of air and moisture vapour therethrough. A fabric cover 36 in its turn envelopes the foam layer. Fabric cover 36 is stretched relatively tightly between the lateral margins 20 of shell support 12, to leave an air space 38 between the cover and foam layer 32. Fabric cover is preferably of a knitted material cut so as to be preferably stretchable in the lateral direction. Cover 36 is provided with a lateral separable seam 40 joined by a Velcro TM fastener or the like.

Figure 4:
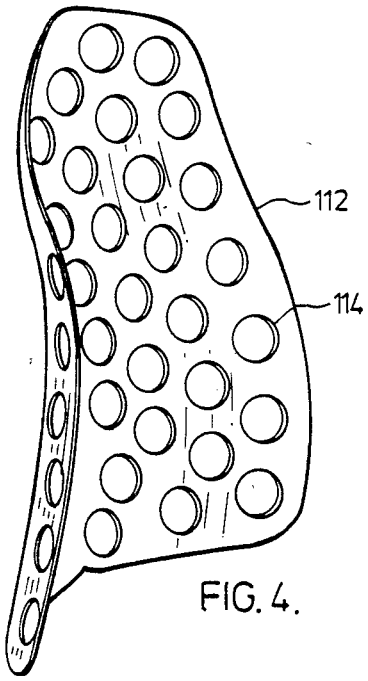
FIG. 4—is similar to FIG. 3, but shows an alternative embodiment of the shell frame.
Figure 5:
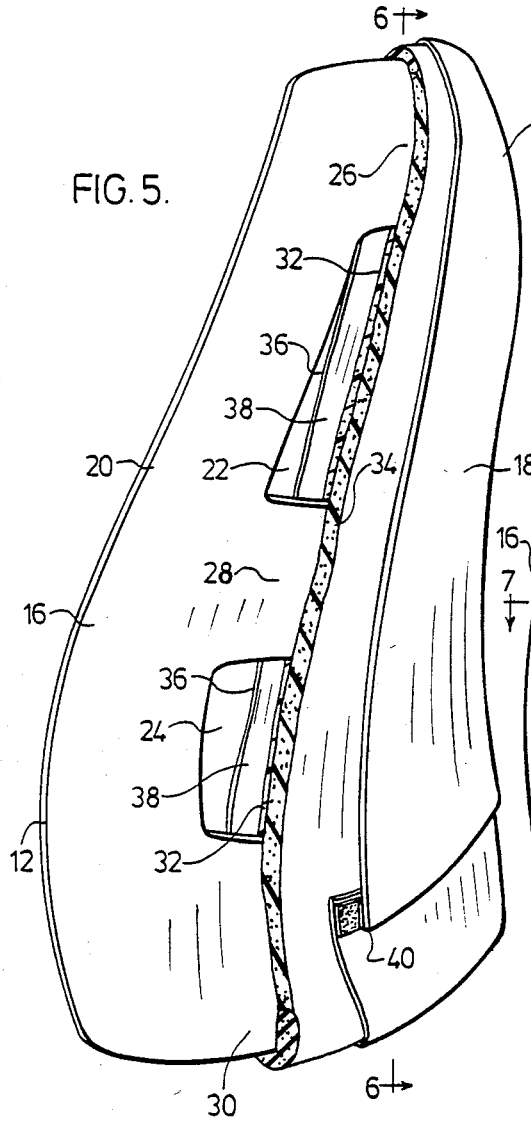
FIG. 5—is similar to FIG. 2, but shows the upholstery partially cut away to reveal internal detail.

In a further embodiment of the invention shown in FIG. 4, a shell support 112 is provided with a plurality of openings 114 therein distributed generally uniformly over the surface of the support within the margins thereof, shell support 112 being otherwise identical to shell support 12.

Figure 8:
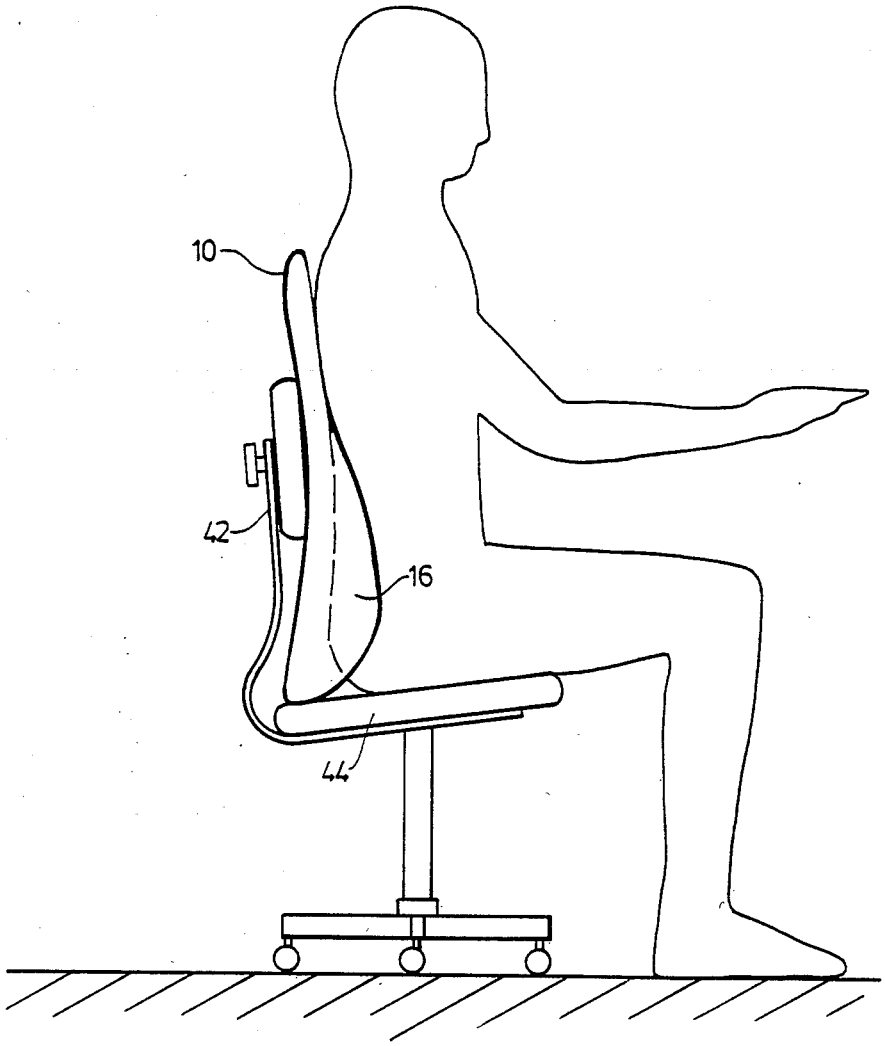
FIG. 8—shows in side elevation a back support in use.

Having described the structure of backrest 10 the manner of use will now be described. Backrest 10 is typically interposed between the back of a person and a supporting chair back 42, where the person is seated, as shown in FIG. 8. It will be apparent that backrest 10 could be unified with the seating portion 44 of the chair, or otherwise be integrated into the structure of the chair, or indeed any other structure upon which the frame of a person is reposed. Advantages of the separable structure reside in its portability, and also the ease of adjustment. Desirably when used backrest 10 is positioned so that horizontal support areas 26,28,30 of shell support 12 support upper portion of the thoracic spine, lower portions of the lumbar spine, and the vertebrae where the thoracic spine and lumbar spine meet.

When back pressure is initially applied to cover 36 the cover stretches in conformity with the users' back, thereby assisting in delocalizing pressure thereon. As the pressure applied to backrest 10 increases, the concavity of shell support 12 is progressively decreased; lateral margins 20 thereby moving apart. This movement of the lateral margins in its turn further stretches cover 36, still further assisting in the delocalization of pressure experienced on spinal areas of the back of a user, with somewhat increased pressure being experienced in the wing areas. It will be appreciated that whilst foam layer 32 acts to delocalize pressure, it is of assistance in reducing relative movement between cover 36 and shell support 12 adjacent margins 20 of the shell support. Cover 36 also assists in ventilating backrest 10. Thus as pressure is alternately applied to and released from cover 36 the volume of air space 38 will vary, with air being alternately expelled from and aspirated into the air space, air thus being caused to circulate through the cover and through the open celled foam layers 32 and 34.

Whilst in the illustrated embodiments presently preferred features of the invention have been put forward, it is to be understood that the invention is not limited to the precise forms illustrated, and that changes may be made thereto without departing from the spirit and substance of the invention.

I claim:

1. A backrest comprising a shell frame member having a central portion and opposed wing portions laterally projecting from said central portion, the lateral dimension of said wing portions increasing in a downward direction, said wing portions connecting only to said central portion, said central portion having in longitudinal section a lower convex section and an upper concave section with an area of inflexion therebetween, said frame member thereby exhibiting in medial longitudinal section a shallow S form, said shell frame member having in transverse section a shallow concave form, said shell frame member being constructed to be relatively stiff and inflexible along said longitudinal medial section and relatively resilient in medial portions transverse thereto so as to tend to decrease the transverse concavity thereof under the influence of the weight of a user, and an upholstered finish comprising a cover stretched between lateral margins of said shell frame member to leave an air space between said shell frame member and said cover.

2. A backrest in accordance with claim 1, wherein said shell frame member is provided with a plurality of openings therethrough.

3. A backrest in accordance with claim 2, wherein said shell frame member is provided with a pair of relatively large transverse elongated openings therein, located respectively on each side of the area of inflexion of said longitudinal section.

4. A backrest in accordance with claim 1, 2 or 3, wherein said shallow, S form continues to the lateral margins of said shell frame member.

5. A backrest as claimed in claim 1, 2 or 3, wherein the area of inflexion of said longitudinal section is about mid height of said shell frame member.

6. A backrest comprising a shell frame member comprising a central portion and opposed wing portions projecting on laterally opposed sides thereof in a unitary structure, the lateral dimension of said backrest generally increasing from top to bottom, the wing portions being supported only by said central portion, said frame member having in medial longitudinal section a shallow S form with an upper concavity and a lower convexity, and in transverse section a shallow concave form, said shell frame member being constructed to be relatively stiff along said longitudinal medial section and relatively resilient in medial portions transverse thereto so as to tend to decrease the transverse concavity thereof under the influence of the weight of the user;

a resilient foam cushion secured to said frame member on at least the forwardly facing surface thereof, and a cover therefor, said cover being maintained under tension in at least the lateral direction by said shell frame member so as to tend to increase the concavity thereof and to thereby form an air space between the cover and said shell frame member, said cover tending to limit the spread of the margins of said shell frame member under the influence of pressure applied thereto by a user.

7. A backrest as claimed in claim 6, wherein said shell frame member is provided with a plurality of openings therethrough.

8. A backrest as claimed in claim 7, wherein said shell frame member is provided with two relatively large transversely elongated openings therein, located respectively on each side of the area of inflexion of said longitudinal section.

9. A backrest as claimed in claim 6, 7 or 8, wherein said shallow S form continues to the lateral margins of said shell frame member.

10. A backrest as claimed in claim 6, 7 or 8, wherein the area of inflexion of said longitudinal section is about mid height of said shell frame member.

* * * * *